US010262780B2

(12) United States Patent
Rosenbaum

(10) Patent No.: US 10,262,780 B2
(45) Date of Patent: Apr. 16, 2019

(54) ANALYTICAL INSTRUMENT INDUCTORS AND METHODS FOR MANUFACTURING SAME

(71) Applicant: FLIR Detection, Inc., Stillwater, OK (US)

(72) Inventor: Kevin Rosenbaum, West Lafayette, IN (US)

(73) Assignee: FLIR Detection, Inc., Stillwater, OK (US)

( * ) Notice: Subject to any disclaimer, the term of this patent is extended or adjusted under 35 U.S.C. 154(b) by 0 days.

(21) Appl. No.: 14/709,205

(22) Filed: May 11, 2015

(65) Prior Publication Data

US 2015/0325359 A1 Nov. 12, 2015

Related U.S. Application Data

(60) Provisional application No. 61/991,835, filed on May 12, 2014.

(51) Int. Cl.

| | |
|---|---|
| ***H01F 27/30*** | (2006.01) |
| ***H01F 27/28*** | (2006.01) |
| ***H01F 27/29*** | (2006.01) |
| ***H01F 5/02*** | (2006.01) |
| ***H01F 27/40*** | (2006.01) |
| ***H01J 49/42*** | (2006.01) |

(52) U.S. Cl.
CPC ..... *H01F 5/02* (2013.01); *H01F 27/2823* (2013.01); *H01F 27/402* (2013.01);
(Continued)

(58) Field of Classification Search
CPC .... H01F 27/402; H01F 27/24; H01F 27/2823; H01F 5/02; H01F 2005/022;
(Continued)

(56) References Cited

U.S. PATENT DOCUMENTS 2,082,121 A * 6/1937 Rypinski ..... H01F 37/00 318/471
2,464,820 A * 3/1949 Livera ..... H01C 3/16 242/445.1

(Continued)

FOREIGN PATENT DOCUMENTS

| | | |
|---|---|---|
| CN | 102281009 | 12/2011 |
| CN | 201510513780.4 | 11/2017 |
| GB | 504201 | 4/1939 |

*Primary Examiner* — Mang Tin Bik Lian
(74) *Attorney, Agent, or Firm* — Wells St. John P.S.

(57) ABSTRACT

Analytical instrument inductors are provided that can include bundled wired conductive material about a substrate. Analytical instrument inductors are also provided that can include: a tubular substrate defining a plurality of flanges extending outwardly from a core of the substrate wherein opposing flanges define portions of the core; at least one pair of wires wound about a first portion of the core and between at least two flanges, the pair of wires extending to and wound about a second portion of the core; and wherein the one pair of wires are operatively coupled to an analytical instrument to provide inductance. Methods for preparing an instrument inductor are provided. The methods can include bundling wires about and within multiple exterior openings of a hollow-cored substrate; and connecting each of the bundles across the openings.

12 Claims, 18 Drawing Sheets

(52) U.S. Cl.
CPC ..... *H01J 49/422* (2013.01); *H01F 2005/022* (2013.01); *Y10T 29/49073* (2015.01)

(58) Field of Classification Search
CPC ..... H01F 27/325; H01F 17/02; H01F 17/03; H01F 2005/027; H01J 49/422; Y10T 29/49073
USPC ..... 336/172, 208, 170, 198; 29/605
See application file for complete search history.

(56) References Cited

U.S. PATENT DOCUMENTS 3,739,312 A * 6/1973 Knebel ..... H01F 5/02 242/125.1
4,339,739 A * 7/1982 Dron ..... G01D 5/2258 336/136
4,473,811 A * 9/1984 Schauble ..... H01F 19/02 29/605
5,939,955 A * 8/1999 Chen ..... H03H 7/0115 333/167
7,269,890 B2 * 9/2007 Nagano ..... H02K 3/47 242/536
7,973,277 B2 7/2011 Rafferty
7,990,245 B1 * 8/2011 Krichtafovitch ..... H01F 27/325 336/198
2003/0173424 A1 9/2003 Dentes et al.
2005/0280492 A1 * 12/2005 Kohno ..... H01F 38/10 336/208
2008/0048112 A1 2/2008 Makarov et al.
2009/0127456 A1 5/2009 Makarov et al.
2010/0301952 A1 12/2010 Worthington

* cited by examiner

ANALYTICAL INSTRUMENT INDUCTORS AND METHODS FOR MANUFACTURING SAME

CROSS REFERENCE TO RELATED APPLICATION

This application claims priority to U.S. Provisional Patent Application Ser. No. 61/991,835 which was filed on May 12, 2014, the entirety of which is incorporated by reference herein.

STATEMENT AS TO RIGHTS TO INVENTIONS MADE UNDER FEDERALLY-SPONSORED RESEARCH AND DEVELOPMENT

This invention was made with Government support under Contract No. HSHQDC-09-00057 awarded by the U.S. Department of Homeland Security, Science and Technology Directorate, Explosives Division. The Government has certain rights in the invention.

TECHNICAL FIELD

The present disclosure relates generally to analytical instrumentation and in particular embodiments, to analytical instrumentation that relies on electronics. Particular aspects of the disclosure relate to analytical instrument inductors and methods for producing same.

BACKGROUND

Analytical instrumentation such as mass spectrometry instrumentation often utilize an inductor such as an RF inductor that includes a resonant circuit for producing signals required for the analytical instrumentation. In particular example uses, RF signals can be required by many mass spectrometers, and for generating wave forms, for example. There is a need in the art for smaller designs of analytical instrumentation to make them hand held and more portable. The present disclosure provides a novel inductor design that can be utilized within analytical instrumentation and in particular embodiments, mass spectrometry instrumentation.

SUMMARY OF DISCLOSURE

Analytical instrument inductors are provided that can include bundled wired conductive material about a substrate. The substrate can define a plurality of openings about a hollow core, with each of the openings confining a plurality of the bundled wires and each bundle being connected with a wire across the openings.

Analytical instrument inductors are provided that can include: a tubular substrate defining a plurality of flanges extending outwardly from a core of the substrate wherein opposing flanges define portions of the core; at least one pair of wires wound about a first portion of the core and between at least two flanges, the pair of wires extending to and wound about a second portion of the core; and wherein the one pair of wires are operatively coupled to an analytical instrument to provide inductance.

Methods for preparing an instrument inductor are provided. The methods can include bundling wires about and within multiple exterior openings of a hollow-cored substrate; and connecting each of the bundles across the openings.

DRAWINGS

Embodiments of the disclosure are described below with reference to the following accompanying drawings.

DESCRIPTION

This disclosure is submitted in furtherance of the constitutional purposes of the U.S. Patent Laws "to promote the progress of science and useful arts" (Article 1, Section 8).

Figure 1:
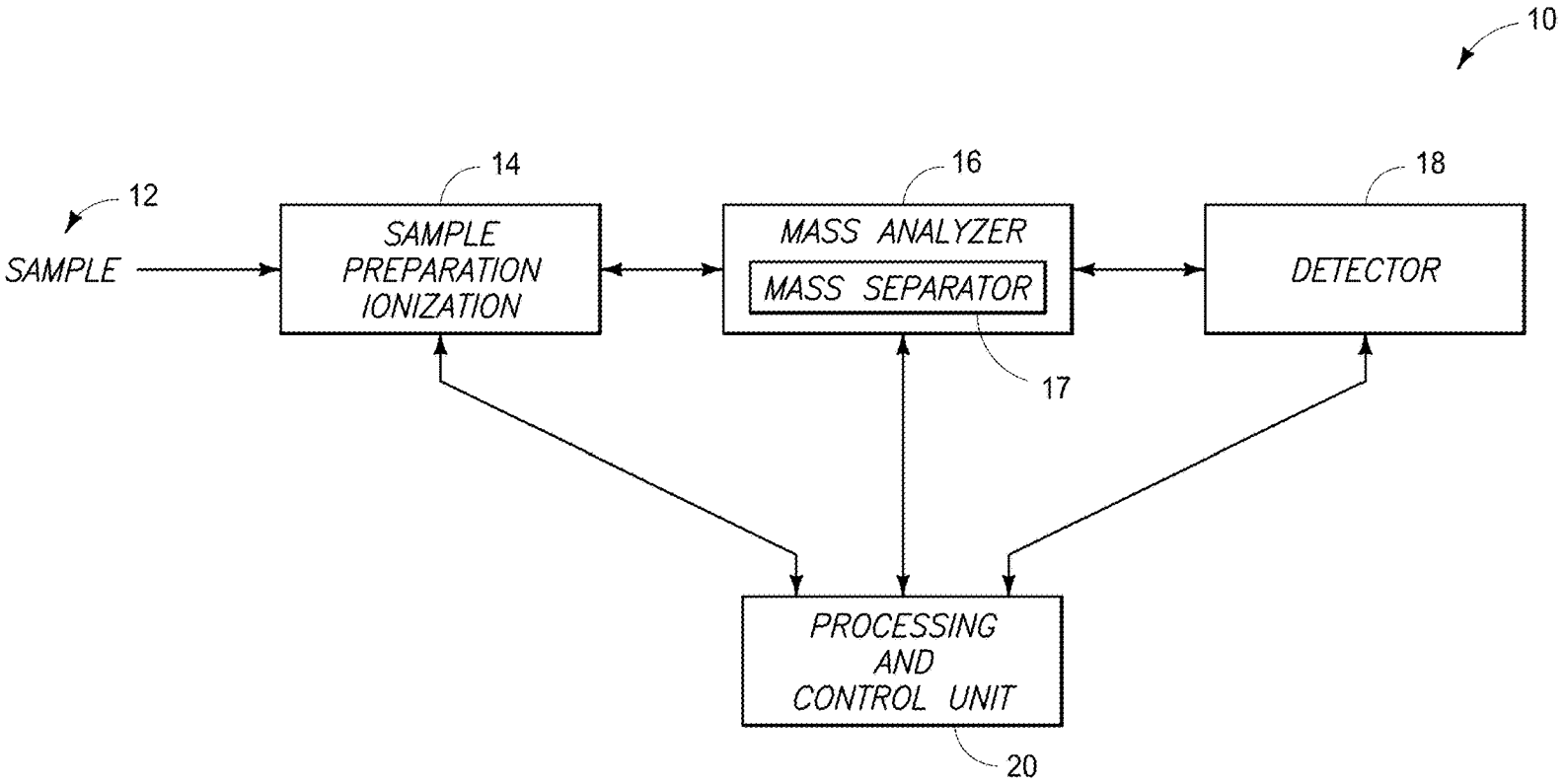
FIG. 1 is a schematic of an instrument according to an embodiment of the disclosure.

The present disclosure will be described with reference to FIGS. 1-34. Referring first to FIG. 1, an example instrument 10 is shown by schematic diagram. Example instrument 10 can be configured as a mass spectrometer, and this mass spectrometer may include several components. Example components can include sample preparation ionization component 14, mass analyzer component 16, which include a mass separator, as well as a detector component 18. These three components 14, 16, and 18 can be coupled to a processing and control unit. Instruments such as these are described in U.S. Pat. No. 7,582,867 issued Sep. 1, 2009, the entirety of which is incorporated by reference herein.

Unique to this instrument is the inclusion of an inductor that can be utilized to generate RF signals that can be utilized to dictate the mass separation parameters. Other instruments that can utilize this inductor can include but are not limited to nuclear magnetic resonance and/or low frequency instruments such as those using less than 1.6 mHz.

Figure 2:
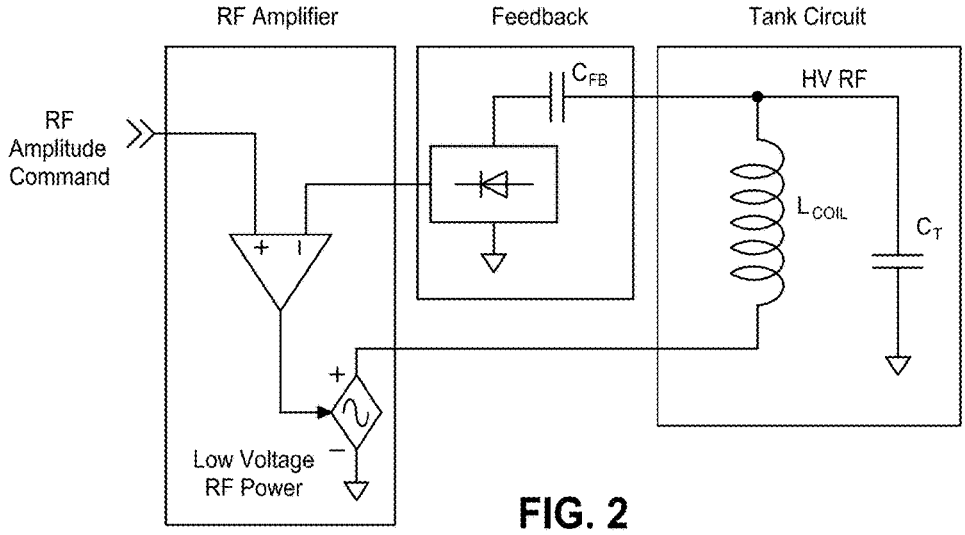
FIG. 2 is a circuit diagram of an RF subsystem according to an embodiment of the disclosure.

Referring to FIG. 2, an example circuit is shown that includes an RF amplifier, feedback, and tank circuit. Within a tank circuit can be a coil as shown, and this coil has in the past been configured as a solenoid inductor or coil. Typical designs have utilized air-core inductors in the past to prevent magnetic saturation.

Figure 3:
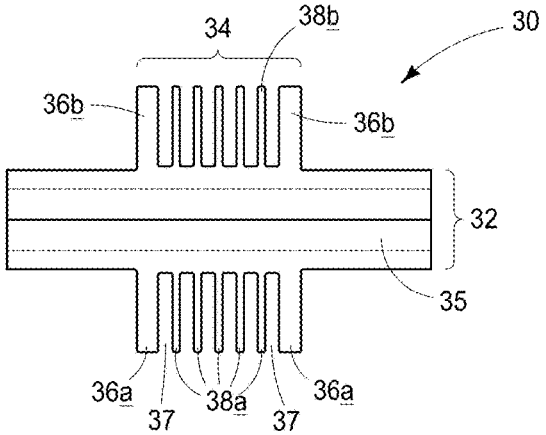
FIG. 3 is a depiction of a substrate of a coil according to an embodiment of the disclosure.

Referring next to FIG. 3, a substrate that can be utilized for the inductor of the present disclosure is shown. Substrate 30 is depicted as one cross section of a circular or tubular designed substrate for the mounting of metallic coils thereon. The mounting of metallic coils can include the bundling of wires about the substrate. The wires can be in pairs and may include multiple pairs of wires.

Substrate 30 can include a central cylinder 32 that may have one or more of a plurality of flanges 34 extending therefrom. Within that set of flanges 34 can be restraining flanges 36*a/b* on the outermost portion, as well as interior flanges 38*a/b*. As can be seen, restraining flanges 36*a/b* may have a width or depth that is significantly larger than interior flanges 38*a/b*. The combination of the cylinder and flanges can define the openings or recess 37 of the substrate about the hollow core 35 of the central cylinder 32. As can be seen, the substrate can be substantially tubular, but the substrate can be insulative as well. In accordance with example implementations, even number of portion of the core are defined by opposing flanges, the substrate can be further defined by two sections 132 and 134 (FIG. 13, for example), with each of the sections including half of the portions of the core.

The flanges can define portions of the core 43, for example. At least one pair of wires can be wound about a first portion of the core and between at least two flanges. The pair of wires can extend to and be wound about a second portion of the core. The first and second portions of the core may be defined by at least three flanges.

The inductor can include another pair of wires wound about a third portion of the core and between at least two flanges. One of the two flanges defining the third portion of the core can be one of the two flanges defining the first portion of the core. The other pair of wires can extend to and about a fourth portion of the core. In accordance with example implementations, an even number of portions of the core are defined by the flanges. The substrate can further define two sections with each section including half of the portions of the core.

In accordance with example implementations, flanges can extend approximately 0.3 inches from the exterior of the central tubular construct 32. The entire width in one cross section extending from flange edge to opposing flange edge can be approximately 1 inch, and the entire length of the cylindrical substrate can be approximately 1.6 inches. In accordance with example implementations, one set of flanges 34 can be aligned to be about 0.5 inches from either end of the entire construct, thus taking up approximately 0.6 inches. Each individual flange can be approximately 0.025 inches in depth, and the spacing between the flanges can be approximately 0.055 inches in width. In accordance with example implementations, the larger edge construct flange 36 can be approximately 0.080 inches in width. In accordance with example implementations, the depth or outer perimeter of the central tubular construct 32 can be approximately 0.375 inches wide, with an opening of about 0.228 inches.

Figure 4:
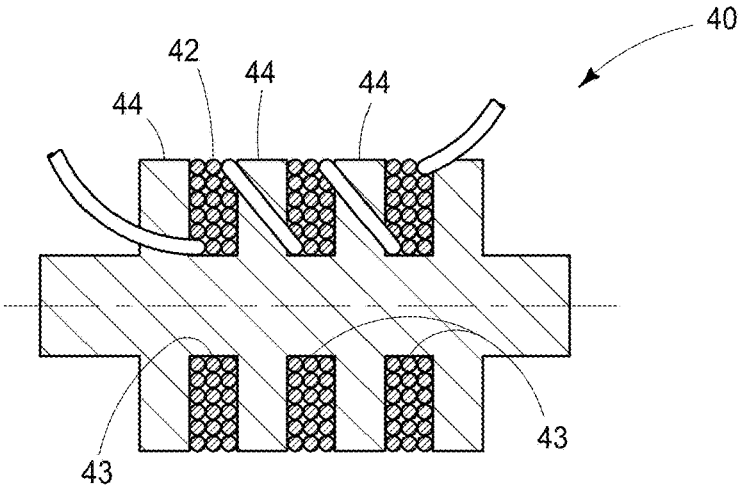
FIG. 4 is another depiction of a substrate and coiled members about same according to an embodiment of the disclosure.

Referring next to FIG. 4, construct 40 is shown in accordance with one cross section with bundled wires 42 therein. In this cross section, multiple bundling of wires can reside in each of opposing openings defined between flanges 44. As can be seen, each of the wires bundled within each individual opening or slot can be connected via a single cross over wire to the slot adjacent thereto, and then additional bundles provided in the slot adjacent thereto. Accordingly bundles of wires using windings can be gradually built, and the resulting construct can have first turns removed from the second as far as possible, the distance of removal being dictated by the construct.

Figure 5:
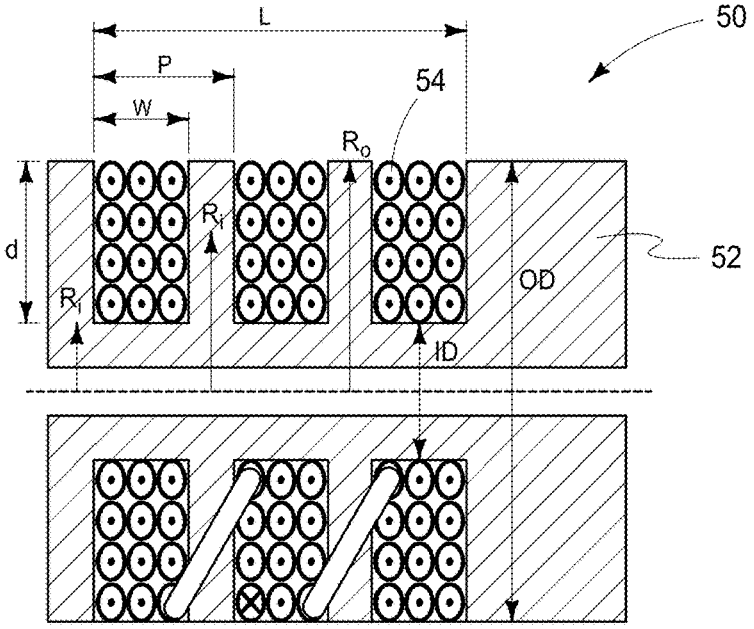
FIG. 5 is another depiction of a substrate having coils there about according to an embodiment of the disclosure.

Referring next to FIG. 5, another example of a construct 50 (the conductor was Type 2 Litz, 34 AWG 26/48, Red Single Polyurethane, 0.002" PFA Jacket to 0.012"+0.002"/−0.004") is shown that demonstrates the relationship of flange construct 52 to the wires 54 bundled therein. As noted in this construct, certain dimensions are provided, and these dimensions are as follows:

| Parameter (inch) | Value | Description |
|---|---|---|
| OD (in) | 1.000 | Outside diameter of conductors |
| ID (in) | 0.400 | Inside diameter of conductors |
| w (in) | 0.055 | |
| s | 6 | Number of slots |
| p (in) | 0.080 | Pitch of slots |
| Pf (turns per in^2) | 3455 | Packing factor (experimentally determined) |

Figure 6:
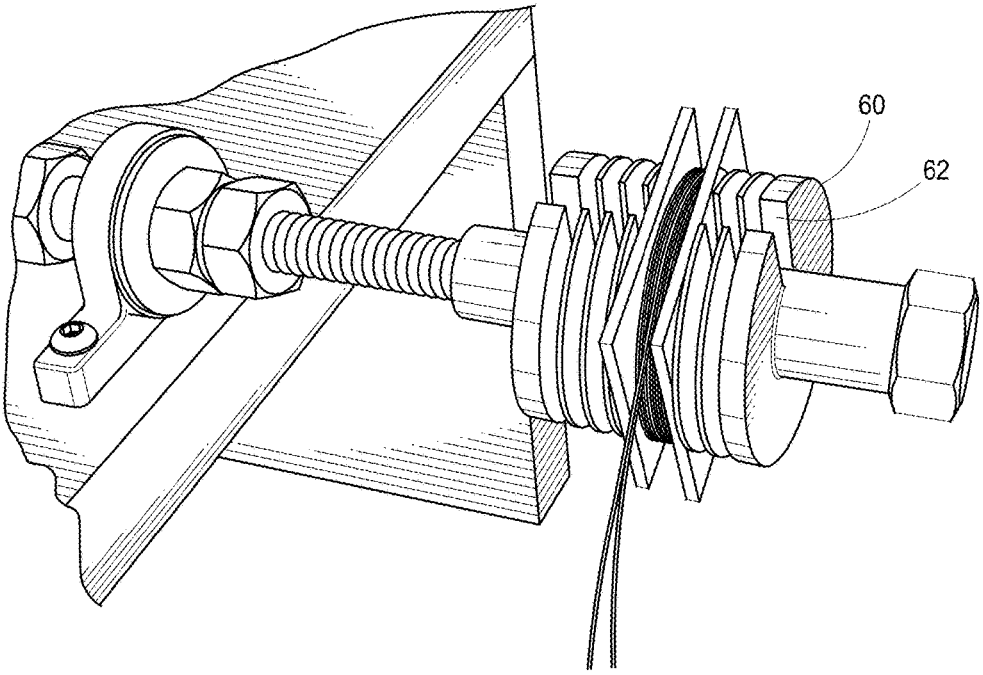
FIG. 6 is a depiction of a coil preparation method at one stage according to an embodiment of the disclosure.

Referring next to FIG. 6, a processing step for preparing the coil according to an embodiment of the disclosure is provided. In accordance with this embodiment of the disclosure, a 6-slot coil for a four-winding inductor (bifilar with center-taps) can be prepared. Shims shown can be utilized on opposing recesses about the recess having wire wound therein. The shims may prevent the winding from collapsing the flanges of the recess during winding, for example. As can be seen in FIG. 6, a coil can be mounted to a stationary fixture, and the coil rotated about an axis to draw wires within slots of the coil. Construct 60 can have a slot 62 extending there through. Slot 62 can be utilized to allow for the crossover of a single wire between different spaces within construct 62 to allow for the single wire crossover between bundles.

Figure 7:
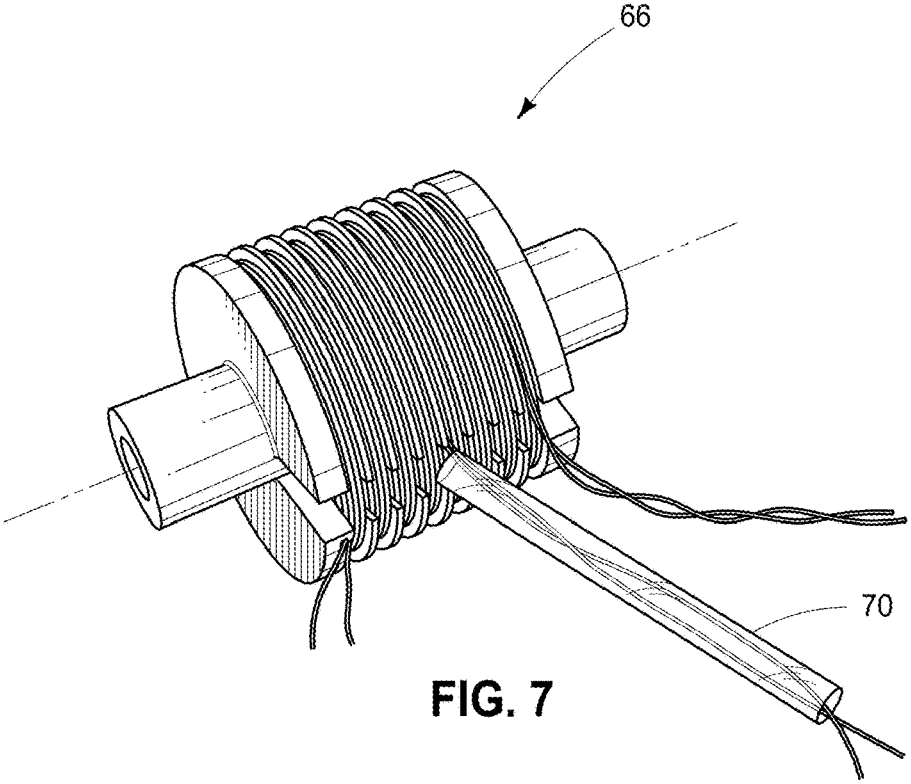
FIG. 7 is a depiction of a coil preparation method at another stage according to an embodiment of the disclosure.

Referring next to FIG. 7, in another stage of processing, another construct 66 is shown. As shown, construct 66 includes a tubular member 70 that can be utilized to provide for the transfer of coils from stock to construct 66.

Figure 8:
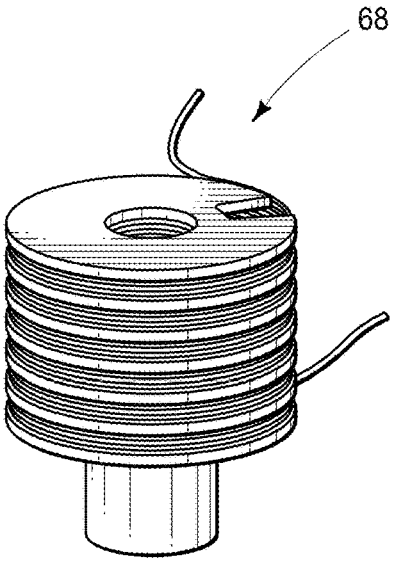
FIG. 8 is a depiction of a coil preparation method at still another stage according to an embodiment of the disclosure.

Referring next to FIG. 8, construct 68 is shown in its completed form. In accordance with example implementations and according to other stages of processing, FIGS. 9 through 30 demonstrate a single construct at different stages of processing. As can be seen, a first pair of wires is wound about the portions of one section of the substrate and then a second pair of wires is wound about the other section of the substrate. To aid in the preparation of the inductor, shims are placed in openings, between flanges, and/or over portions to facilitate the bundling of wires in specific portions.

Figure 9:
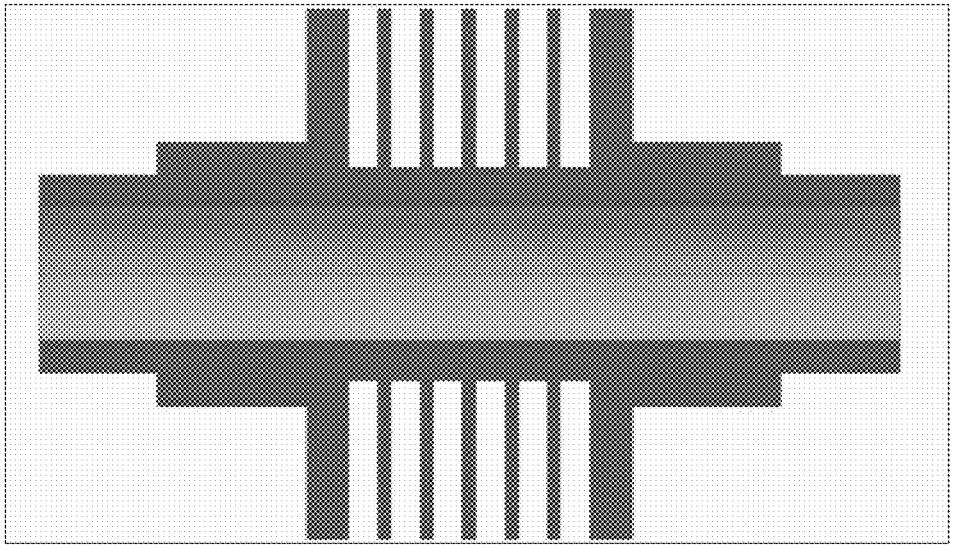
FIGS. 9-30 are depictions of a coil at progressive stages of preparation according to an embodiment of the disclosure.
Figure 10:
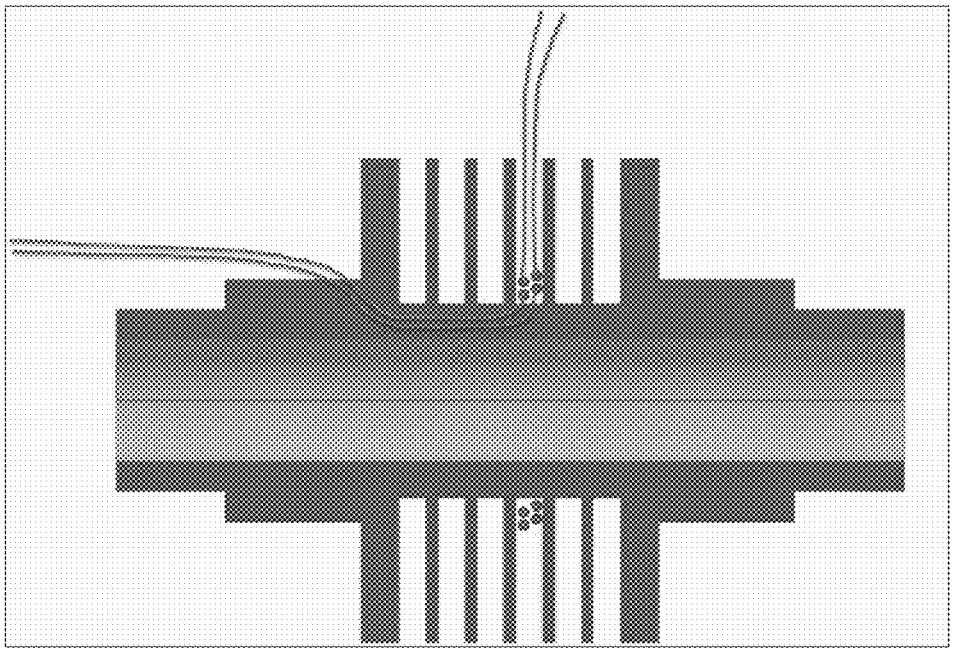

Processing begins with the substrate of the coil in FIG. 9. In FIG. 10, bifilar windings are started as shown with the start end of wire passing from the bottom of slot to the left and secured to the shaft.

Figure 11:
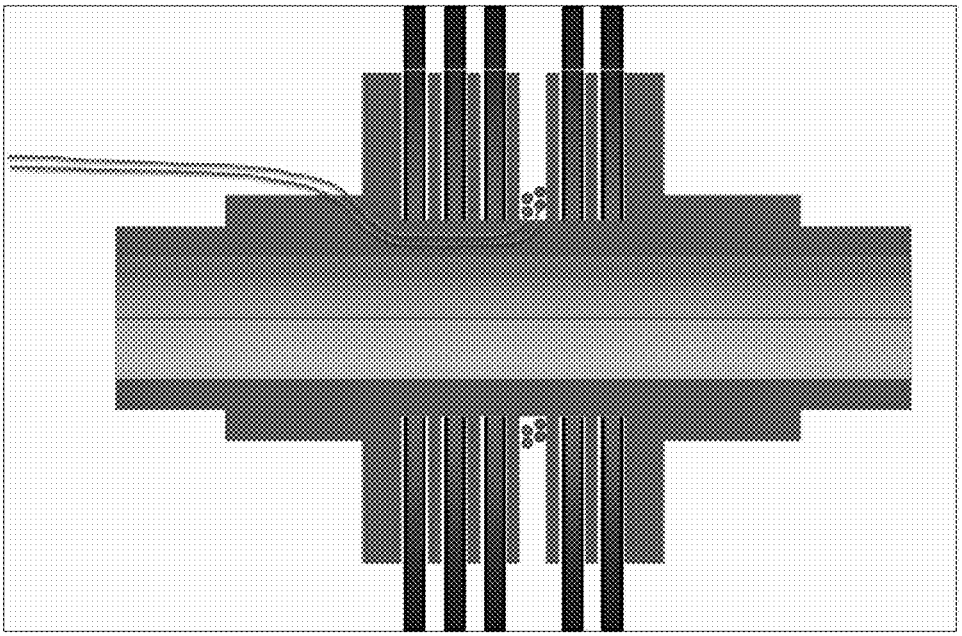
Figure 12:
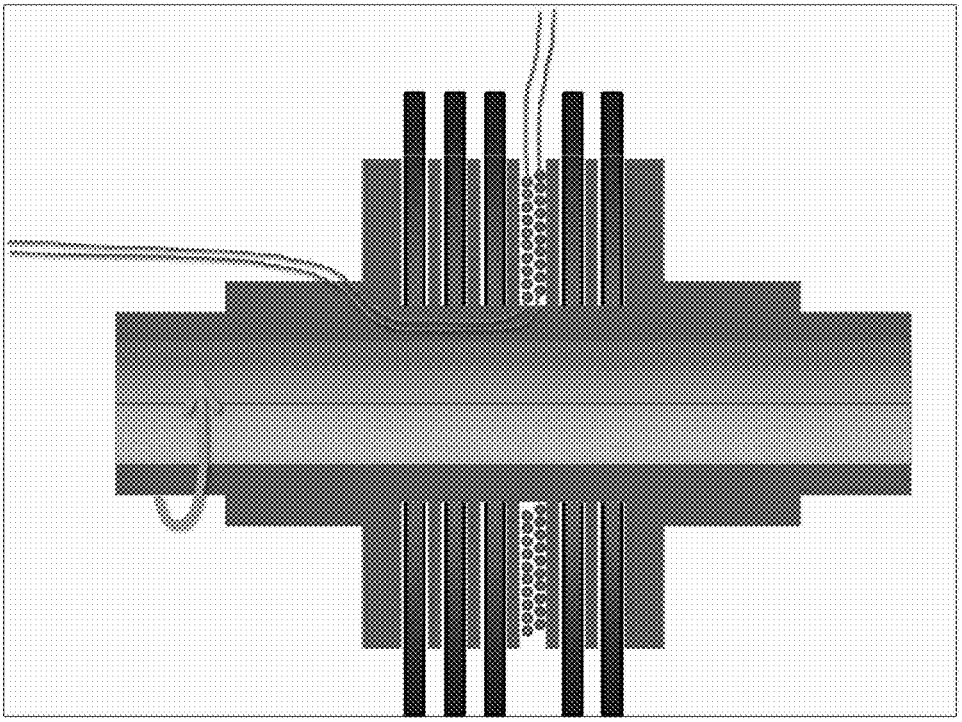
Figure 13:
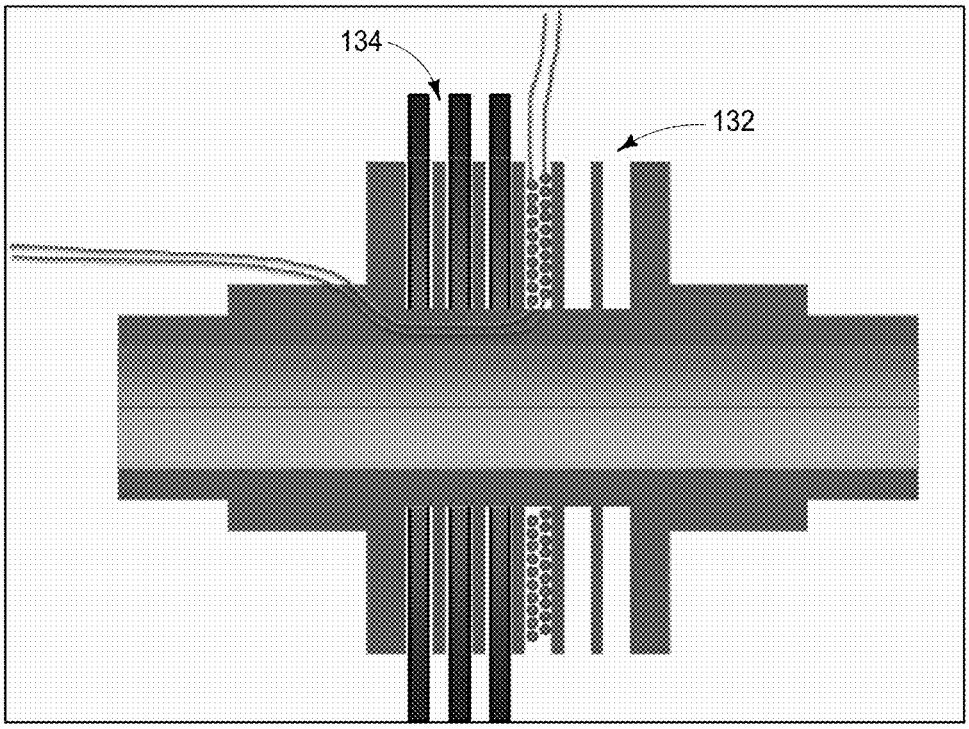
Figure 14:
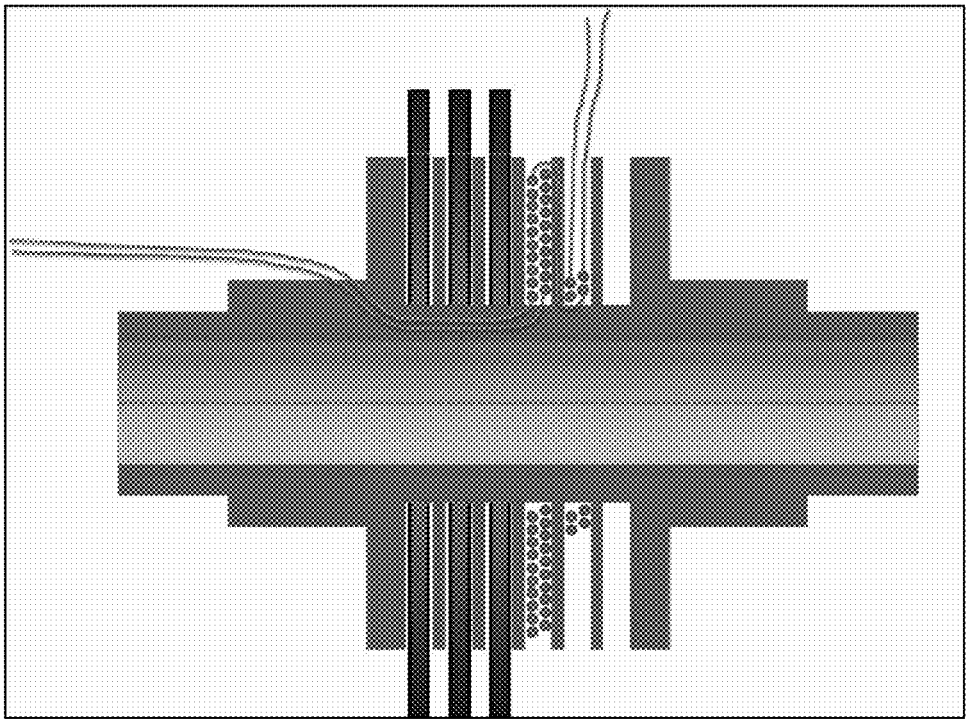

Referring next to FIG. 11, shims can be added to all empty slots to prevent plastic walls from bowing out when winding. The orientation of the shim slots can be opposite of that of the axial cut through the slot walls. FIG. 12 depicts winding the first slot a predefined number of turns while being cautious not to let the windings snag on the shims. In FIGS. 13 and 14, selected shims can be removed for inspection of next step then windings can be routed from top of first slot to bottom of second slot. This occurs along the axial cut through the walls of the slots.

Figure 15:
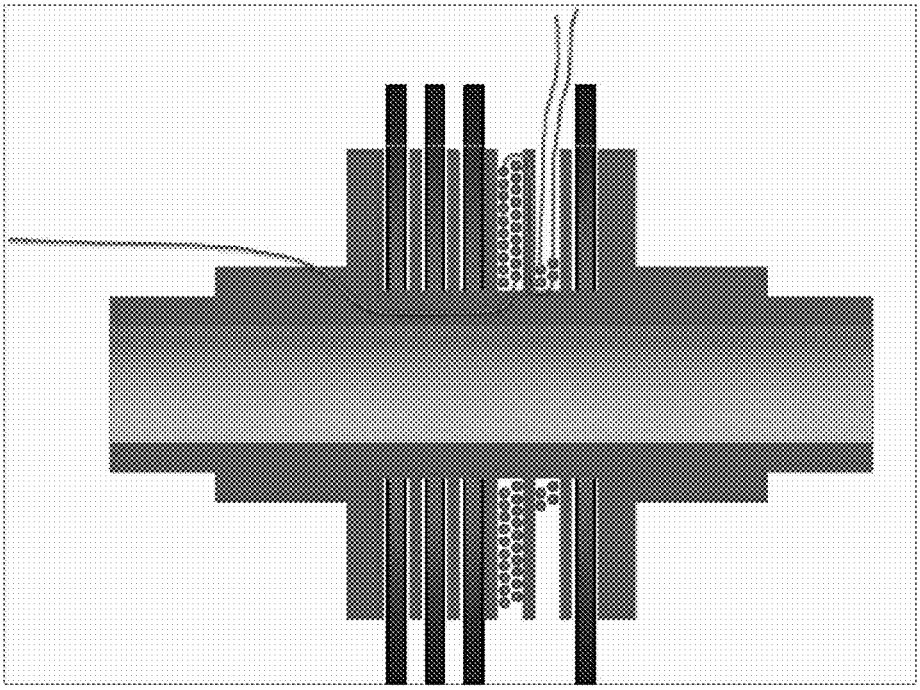
Figure 16:
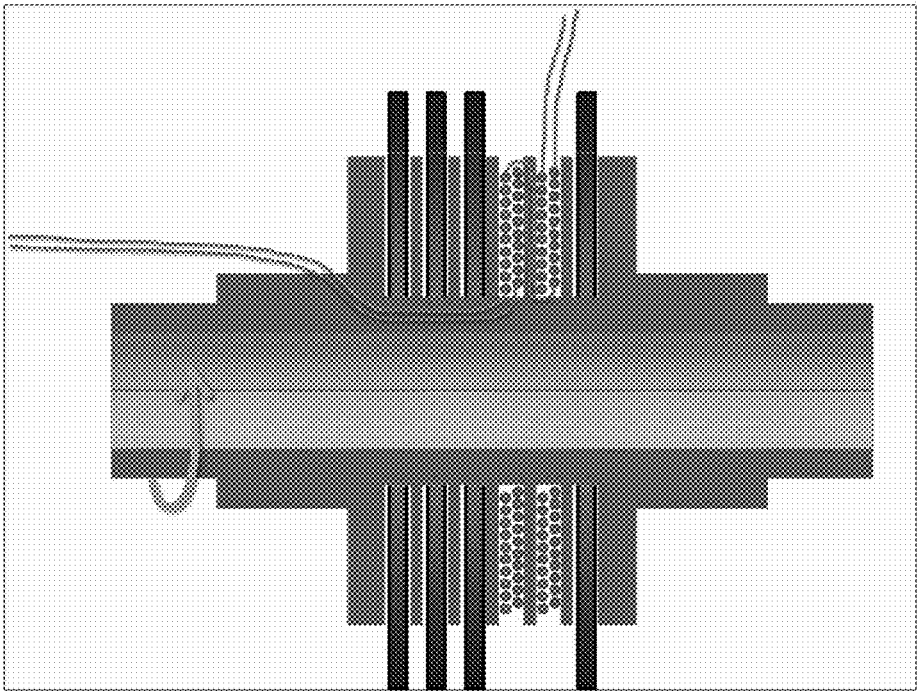
Figure 17:
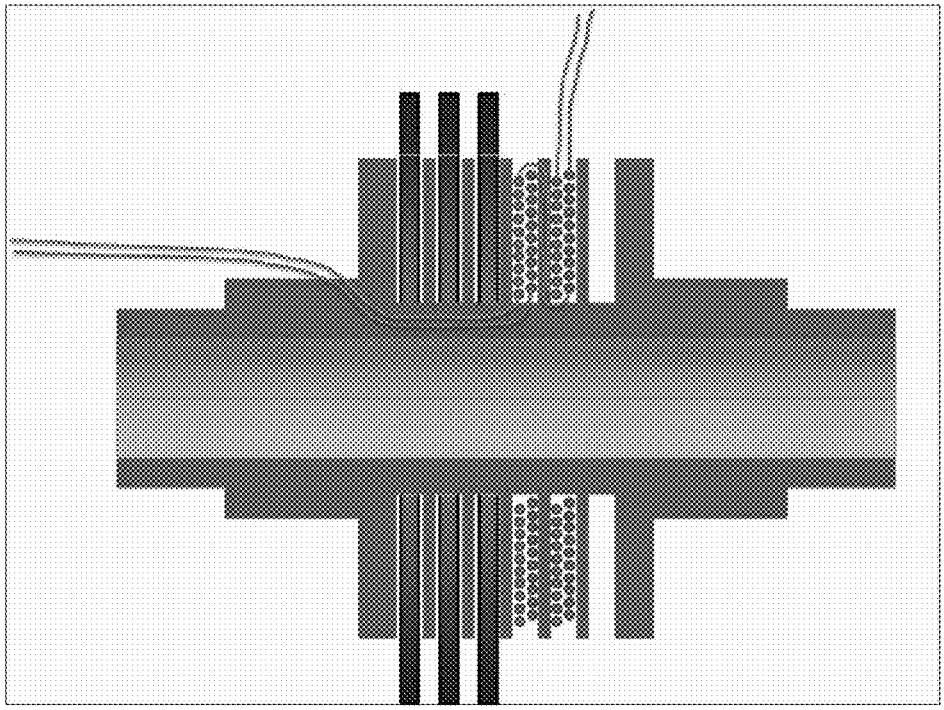
Figure 18:
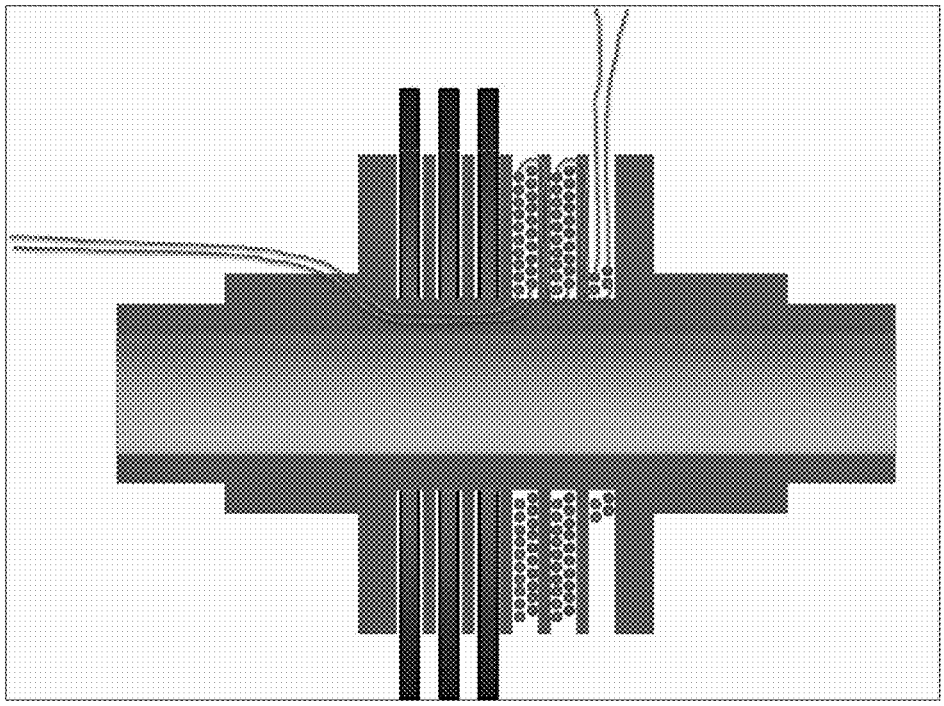
Figure 19:
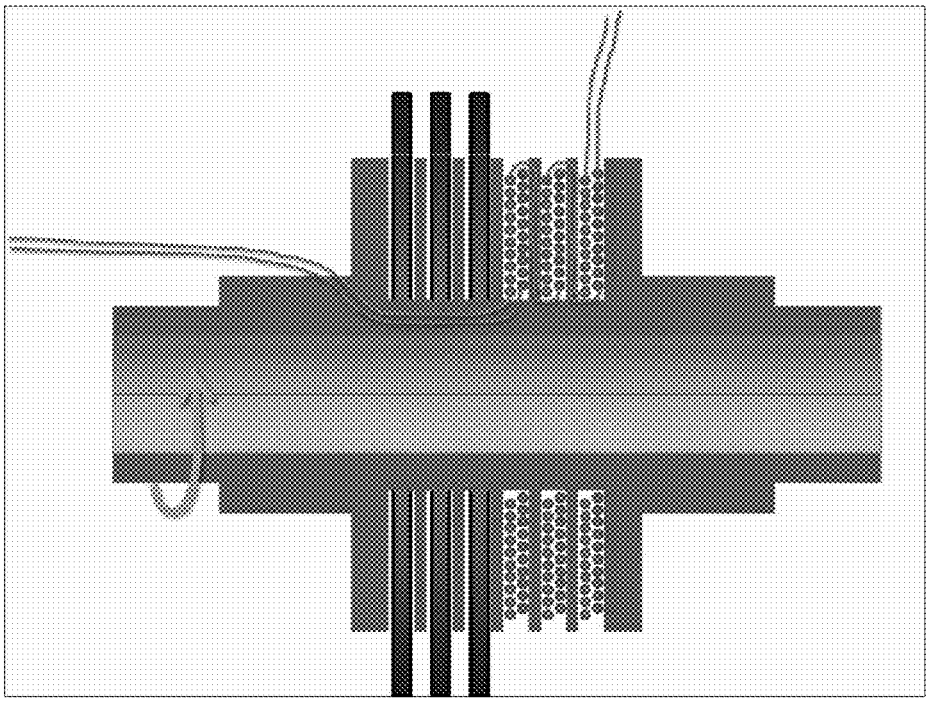
Figure 20:
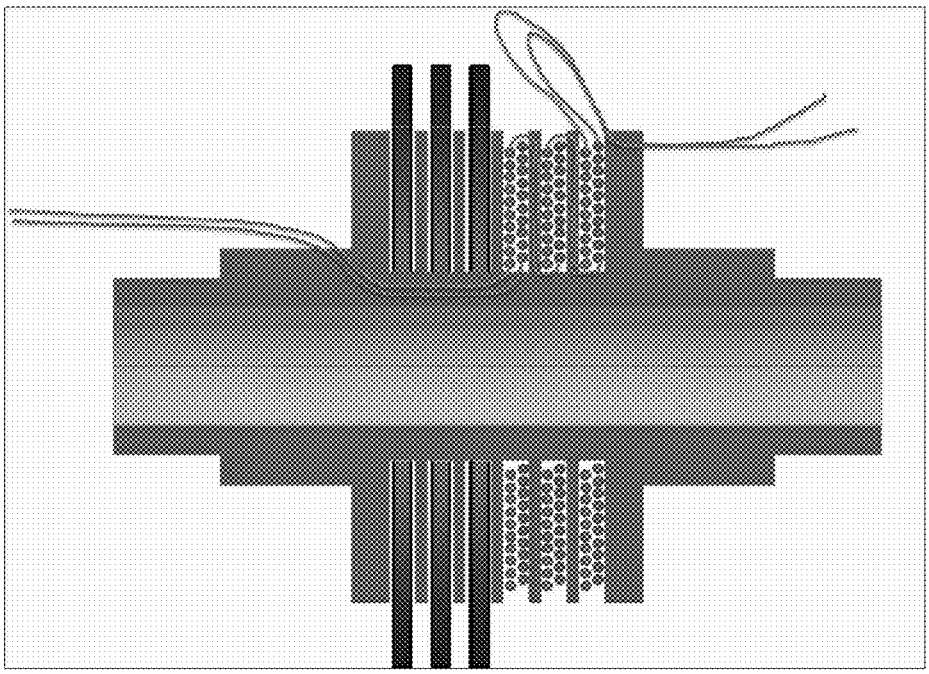
Figure 21:
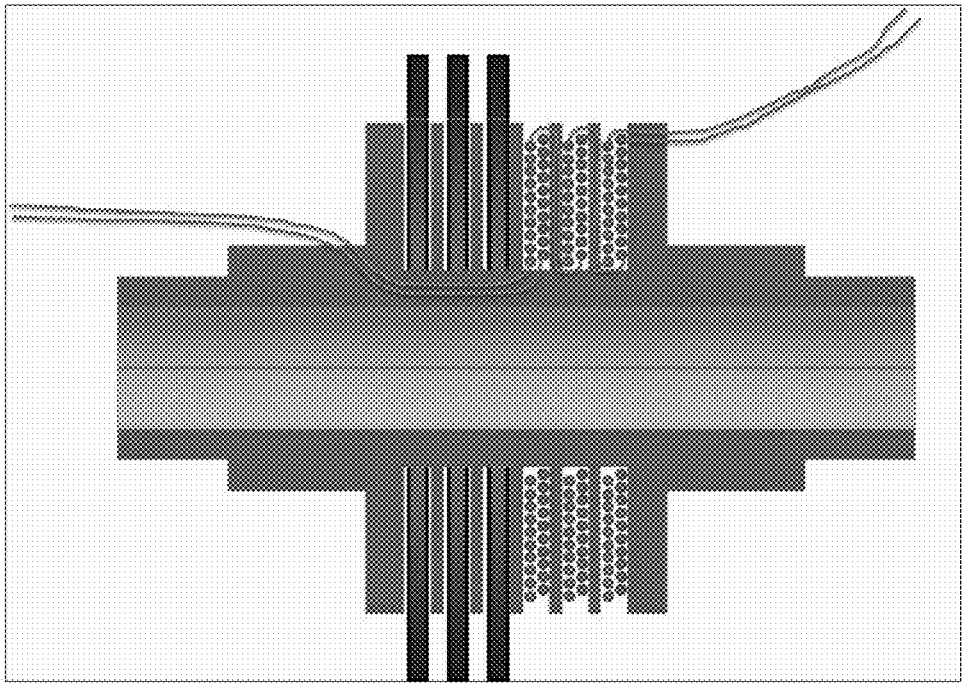
Figure 22:
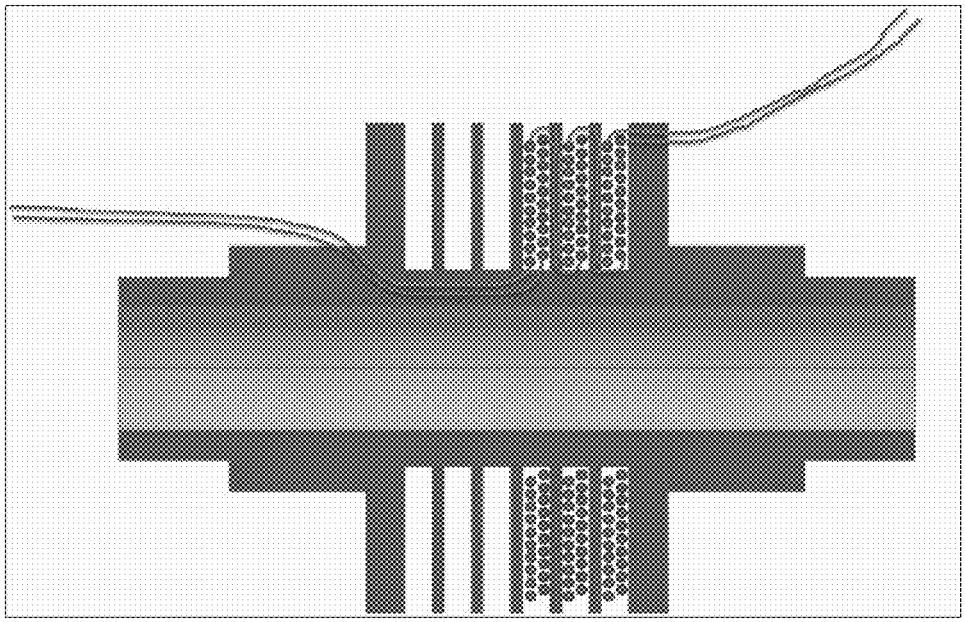
Figure 23:
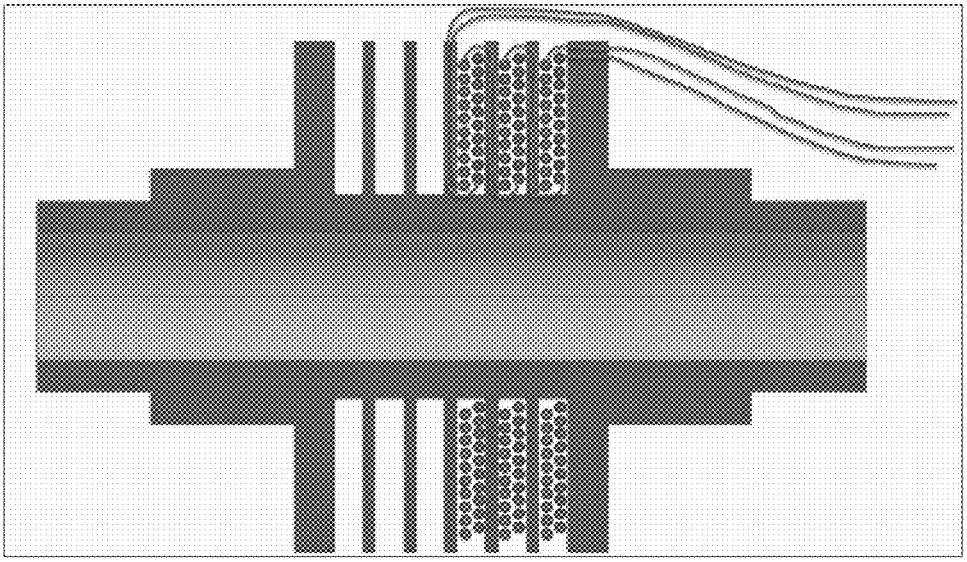
Figure 24:
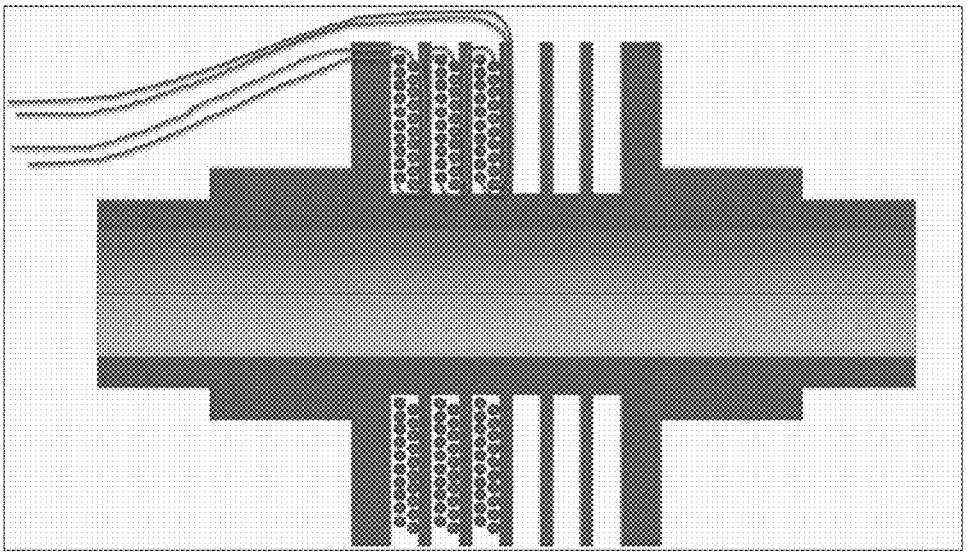
Figure 25:
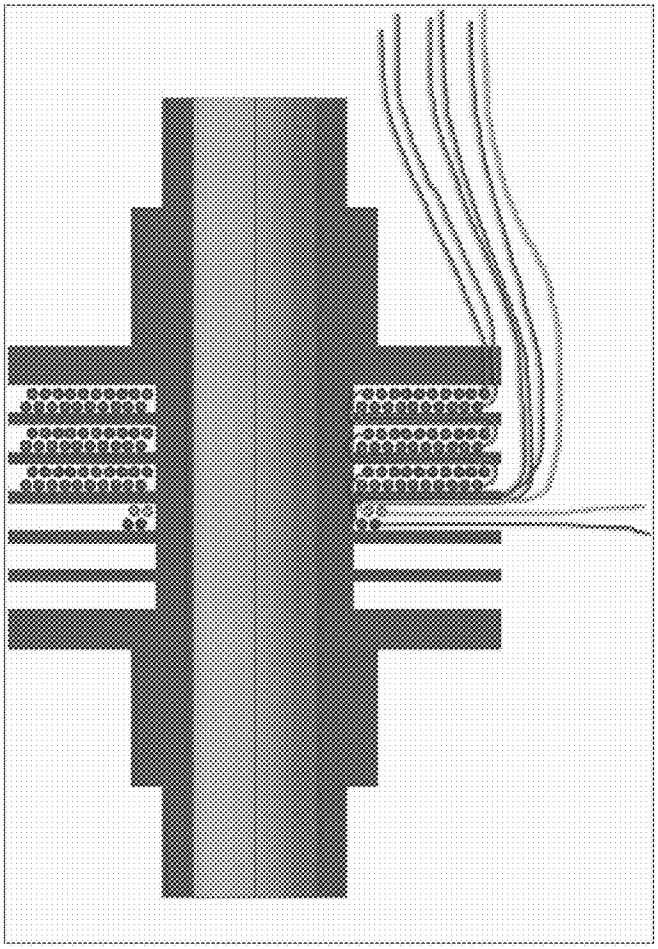
Figure 26:
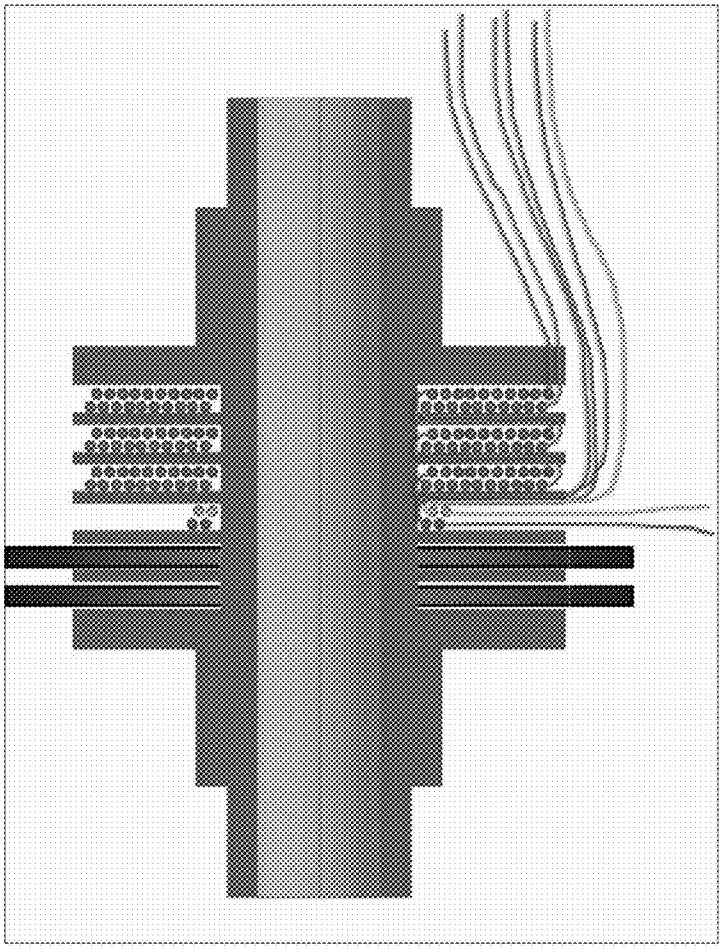
Figure 27:
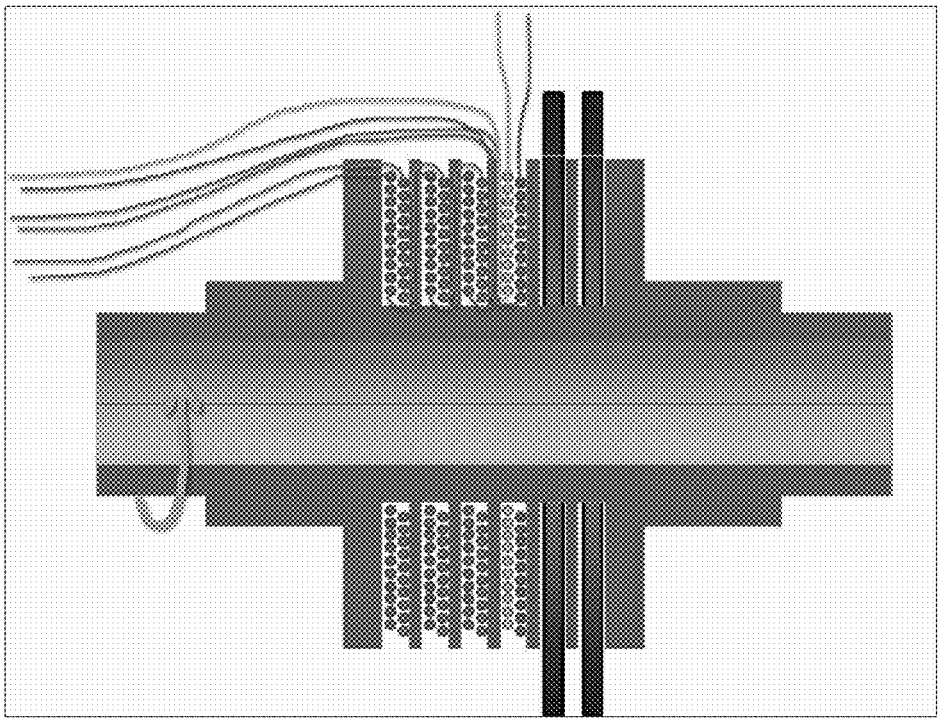
Figure 28:
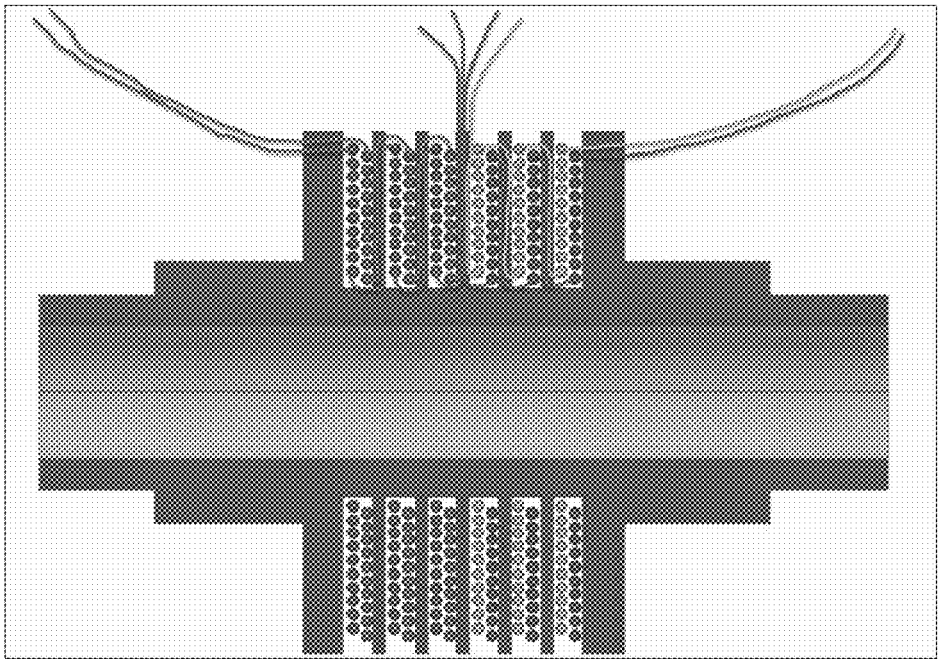
Figure 29:
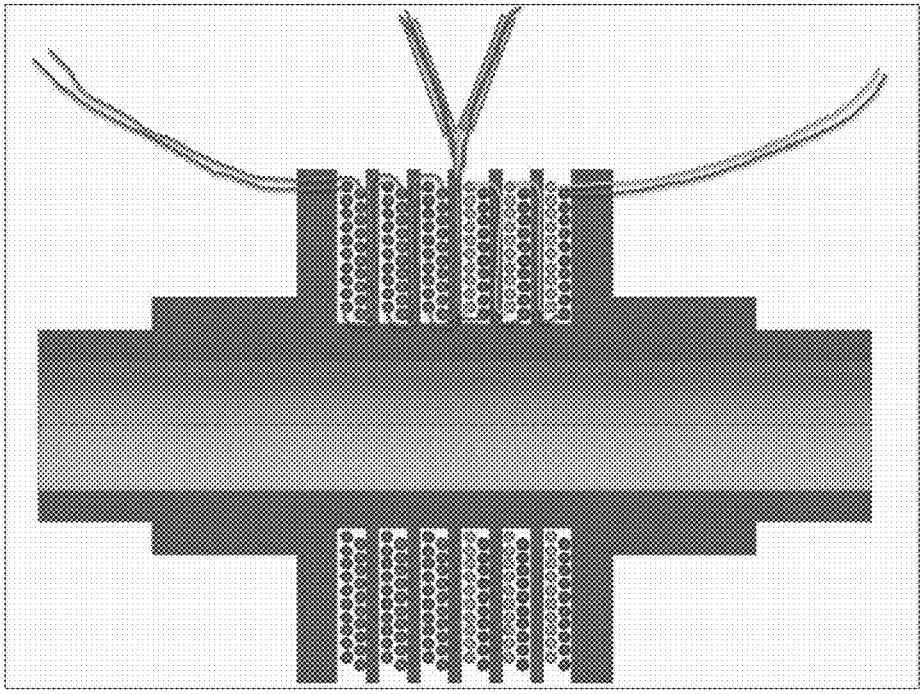
Figure 30:
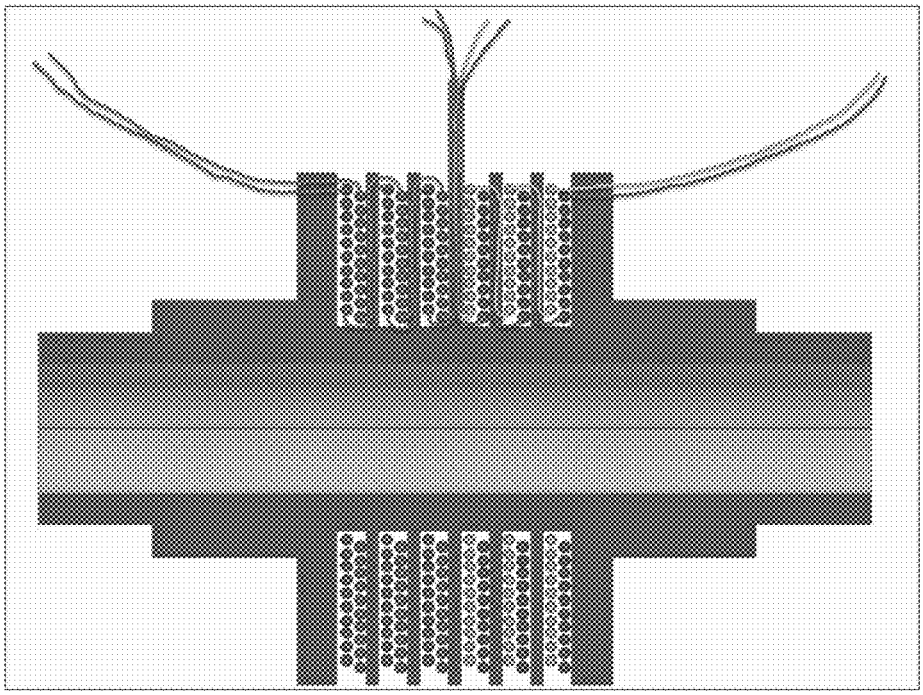

Referring to FIGS. 15 and 16 shims can be returned to the substrate to prevent bowing slots while winding and then in FIGS. 17 and 18, the shims can be removed to complete the winding of one side of construct. Referring to FIGS. 19-21, the windings can be completed then terminated by passing them through the holes of the side wall then pulled through snug.

Referring next to FIGS. 22-30, the opposite half of the construct can be prepared winding from the center out as above. Upon completing the windings tubing can be placed over the two pairs of center-tap conductors of the coil—one for each phase pair.

Figure 31:
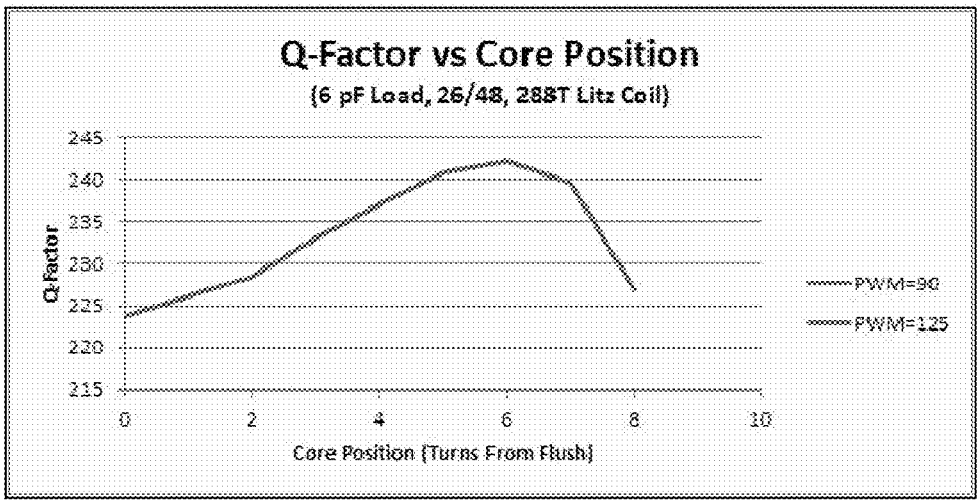
FIG. 31 is performance data utilizing coils of the present disclosure.
Figure 32:
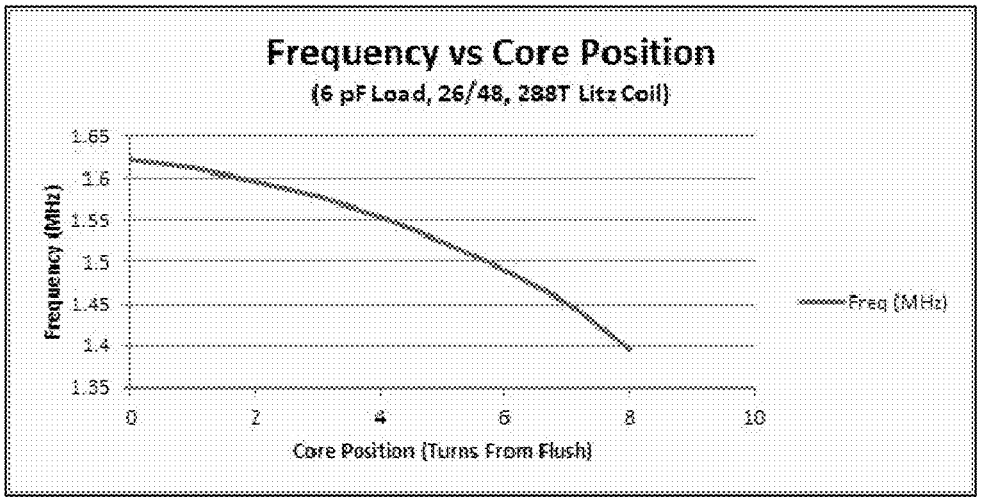
FIG. 32 is additional performance data utilizing coils of the present disclosure.
Figure 33:
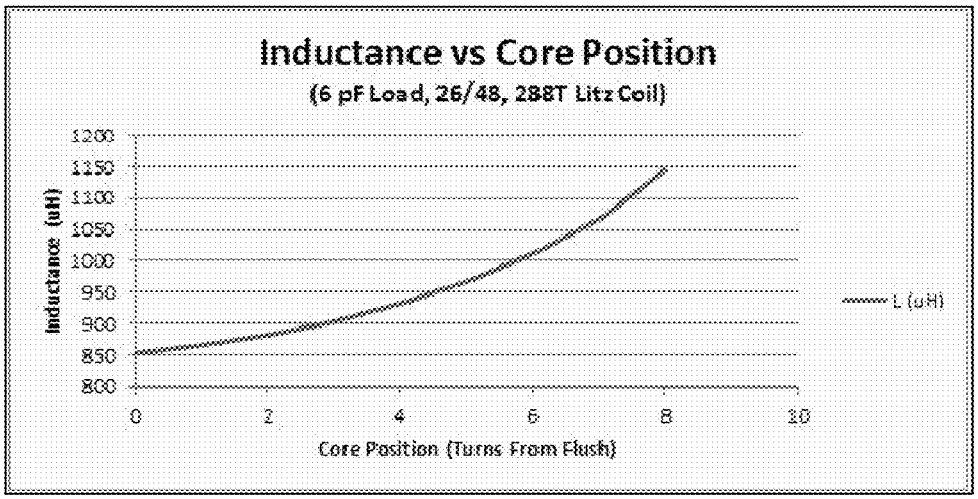
FIG. 33 is additional performance data utilizing coils of the present disclosure.
Figure 34:
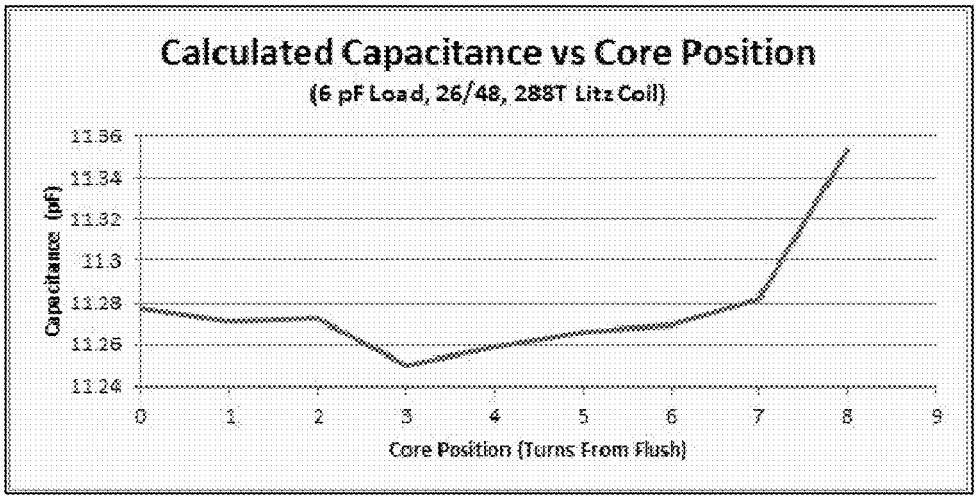
FIG. 34 is additional performance data utilizing coils of the present disclosure.

Referring next to FIGS. 31-34, the inductive coil of the present disclosure was characterized as having the following performance. In FIG. 31 the Q-factor of the coil was measured as a function of the iron powder core position relative to the number of turns they were inserted from the flush face of the coil form. Similarly, the resonance frequency, inductance and calculated system capacitance is shown as a function of core position in FIGS. 34, 35 and 36, respectively.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

What is claimed is:

1. An analytical instrument inductor comprising:

a tubular substrate defining a plurality of flanges extending outwardly from a core of the substrate, wherein at least one flange separates at least two portions of the substrate to define a first portion of the substrate and a second portion of the substrate, wherein one set of recesses is defined by one plurality of flanges in the first portion, and another set of recesses defined by another plurality of flanges in the second portion;

at least two pairs of wires wound about the core, one of the two pairs of wires extending to and being wound about the first portion of the core and between one or more of one pair of the one plurality of flanges to provide multiple stacked windings in each recess, and another of the two pairs of wires extending to and being wound about the second portion of the core and between one or more of another pair of the other plurality of flanges to provide multiple stacked windings in each recess, wherein the one pair of wires extends through all of the recesses of the one set, and the other pair of wires extends through all of the recesses of the second set; and wherein the both pairs of wires are bundled upon exiting the recesses about the at least one flange and are operatively coupled to an analytical instrument to provide inductance.

2. The analytical instrument inductor of claim 1 wherein at least some of the flanges extend normally from an axis of the tubular substrate.

3. The analytical instrument inductor of claim 1 wherein the plurality of recesses are defined by a plurality of pairs of flanges.

4. The analytical instrument inductor of claim 3 wherein each of the recesses are aligned along the length of the tubular substrate.

5. The analytical instrument inductor of claim 3 wherein at least one recess resides about the first portion of the substrate, and at least another recess resides about the second portion of the substrate.

6. The analytical instrument inductor of claim 5 wherein at least a portion of the one pair of wires is received within the one recess, and at least a portion of the other pair of wires is received within the other recess.

7. The analytical instrument inductor of claim 1 wherein the one pair of wires is bound about only the first portion of the substrate and the other pair of wires is bound about only the second portion of the substrate.

8. The analytical instrument inductor of claim 1 wherein the first and second portions of the substrate encompass an entirety of the substrate.

9. The analytical instrument inductor of claim 1 wherein the substrate is substantially tubular.

10. The analytical instrument inductor of claim 1 wherein the substrate is insulative.

11. The analytical instrument inductor of claim 1 wherein the analytical instrument is configured to perform mass separation.

12. The analytical instrument inductor of claim 1 wherein the analytical instrument is configured to perform mass separation using a cylindrical ion trap.

* * * * *